US007084575B2

(12) United States Patent
Abe et al.

(10) Patent No.: US 7,084,575 B2
(45) Date of Patent: Aug. 1, 2006

(54) ORGANIC EL PANEL DRIVE CIRCUIT AND PROPRIETY TEST METHOD FOR DRIVE CURRENT OF THE SAME ORGANIC EL ELEMENT DRIVE CIRCUIT

(75) Inventors: Shinichi Abe, Kyoto (JP); Jun Maede, Kyoto (JP); Akio Fujikawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 33 days.

(21) Appl. No.: 10/898,994

(22) Filed: Jul. 27, 2004

(65) Prior Publication Data

US 2005/0024299 A1 Feb. 3, 2005

(30) Foreign Application Priority Data

Jul. 28, 2003 (JP) ..... 2003-280860

(51) Int. Cl.
*G09G 3/10* (2006.01)
*G09G 5/00* (2006.01)

(52) U.S. Cl. ..... 315/169.1; 315/169.3; 345/214; 345/212; 345/211; 345/204

(58) Field of Classification Search ..... None
See application file for complete search history.

(56) References Cited

U.S. PATENT DOCUMENTS 6,946,801 B1 * 9/2005 Kitahara ..... 315/169.3

FOREIGN PATENT DOCUMENTS

| | | |
|---|---|---|
| JP | 9-232074 | 9/1997 |
| JP | 2001-143867 | 5/2001 |
| JP | 2003-308043 | 10/2003 |
| JP | 2003-308044 | 10/2003 |

* cited by examiner

*Primary Examiner*—Tuyet Thi Vo
(74) *Attorney, Agent, or Firm*—Mattingly, Stanger, Malur & Brundidge, P.C.

(57) ABSTRACT

First analog currents are obtained through a plurality of switch circuits provided correspondingly to output pins of an organic EL drive circuit as drive currents or through output stage current sources. The first analog currents or the drive currents are compared by a comparator provided within the organic EL element drive circuit with a second analog current (reference current) or a current obtained by passing the second analog current through a current source corresponding to the output stage current source. A result of comparison is outputted externally of the organic EL element drive circuit. The drive currents are obtained sequentially at the output pins by turning the switch circuits ON one by one sequentially by a control circuit to sequentially obtain the result of comparison for the drive currents from the organic EL element drive circuit.

19 Claims, 3 Drawing Sheets

ORGANIC EL PANEL DRIVE CIRCUIT AND PROPRIETY TEST METHOD FOR DRIVE CURRENT OF THE SAME ORGANIC EL ELEMENT DRIVE CIRCUIT

BACKGROUND OF THE INVENTION

1. Field of the Invention

The present invention relates to an EL (electro luminescent) element drive circuit and a propriety test method for drive currents of the same organic EL element drive circuit and, in particular, the present invention relates to an organic EL display element drive circuit (driver IC), which generates drive currents to be supplied to terminal pins of an organic EL display panel by converting digital values into analog drive currents by D/A converter circuits and is capable of effectively testing the analog drive currents to be outputted from output pins of the driver IC to the analog respective terminal pins for the propriety thereof.

2. Description of the Prior Art

An organic EL display panel of an organic EL display device, which is mounted on a portable telephone set, a PHS, a DVD player or a PDA (personal digital assistance) and includes 396 (132×3) terminal pins for column lines and 162 terminal pins for row lines, has been proposed and the number of column lines and the number of row lines of such organic EL display panel tend to be further increased.

An output stage of a current drive circuit of such organic EL display panel includes output circuits of, for example, a current-mirror circuit, which are provided correspondingly to respective terminal pins of the organic EL display panel, regardless of the type of drive current, the passive matrix type or the active matrix type.

For example, JP2003-308043A and JP2003-308044A disclose organic EL element drive circuits in each of which D/A converter circuits are provided in an upstream side of respective current mirror output circuits and drive currents to be supplied to respective terminal pins of an organic EL display panel are generated by converting digital display data for terminal pins of the column side into analog drive currents by means of the D/A converter circuits.

Further, JPH9-232074A discloses an organic EL element drive circuit in which organic EL elements arranged in a matrix are current driven and are reset by grounding anodes and cathodes of the organic EL elements. Further, JP2001-143867A discloses a technique with which organic EL elements are current-driven with low power consumption by using DC/DC converters.

The increase in number of terminal pins of the organic EL display panel results in an increase of time required to test a column driver IC for the propriety of the drive currents to be supplied to the respective terminal pins, that is, for whether or not the drive currents supplied to the respective terminal pins are appropriate. Further, due to the increase in the terminal pins, a plurality of column driver ICs are necessary on the side of the column line. In an organic EL element drive circuit of QVGA full color system, for example, 120 terminal pins are necessary for each of R, G and B display colors, so that a total of 360 terminal pins and hence 3 column drivers are necessary nowadays. Therefore, the number of the column driver ICs to be tested tends to be increased.

Further, the column driver IC, which generates drive currents by converting digital display data into analog values by means of D/A converter circuits, has to be tested for whether or not it can normally generate drive currents correspondingly to the display data from the minimum value (all bits are "0") to the maximum value (all bits are "1"). Therefore, the test time required in the test step of the column driver ICs is increased, resulting in degradation of throughput of fabrication of the column driver ICs.

SUMMARY OF THE INVENTION

An object of the present invention is to provide an organic EL element drive circuit, which is capable of efficiently testing for whether or not drive currents to be supplied from output pins of a column driver IC to respective terminal pins of an organic EL display panel are appropriate.

Another object of the present invention is to provide a test method for testing drive currents of the organic EL element drive circuit.

In order to achieve the above-mentioned objects of the present invention, the organic EL element drive circuit for generating drive currents at output pins thereof corresponding to respective terminal pins of an organic EL display panel is featured by comprising:

a plurality of first D/A converter circuits provided correspondingly to the output pins, for converting digital display data into first analog currents, respectively;

a plurality of switch circuits provided correspondingly to the output pins, respectively, each switch circuit being responsive to the first analog current or a current derived from the first analog current by a output stage current source provided correspondingly to the output pin as a drive current;

a second D/A converter circuit having a LSB (least significant bit) input having resolution higher than a LSB input of the first D/A converter circuit, for converting a digital data corresponding to the display data into a second analog current used as a reference of comparison;

a comparator circuit for comparing the first analog currents from the switch circuits or the currents derived from the first analog currents with the second analog current or a current derived from a current source similar to the output stage current source of the first D/A converter circuit, a result of comparison result being outputted externally of the organic EL element drive circuit; and a control circuit for turning the switch circuits ON one by one sequentially.

As such, in the present invention, the first analog currents from the switch circuits or the currents derived from the first analog currents by the output stage current sources are compared with the second analog current (comparative reference current) or the current derived from the second analog current by the current source similar to the output current source of the first D/A converter circuit and the result of comparison is outputted externally of the organic EL element drive circuit.

By turning the switch circuits ON one by one sequentially under control of the control circuit, the drive currents corresponding to the respective output pins are obtained sequentially and the comparison result of these drive currents are obtained sequentially from the organic EL element drive circuit.

Further, the data for generating the comparative reference current: is made correspondent to the display data of the first D/A converter circuits and is added with, for example, 1 bit as a new LSB and supplied to the second D/A converter circuit as a data having higher resolution. Alternatively, the reference current to be compared with drive currents corresponding to the respective output pins is generated by adding a current, which is smaller than the analog current corresponding to the LSB of the first D/A converter circuit, to the second analog current. In this manner, it becomes easily possible, within a short time, to test for the propriety of the drive currents outputted to the respective terminal pins of the driver IC according to the display data.

As a result, it is possible to shorten the test time in the test step of the column driver IC to thereby improve the throughput of fabrication of the column driver IC.

DETAILED DESCRIPTION OF THE PREFERRED EMBODIMENTS

Figure 1:
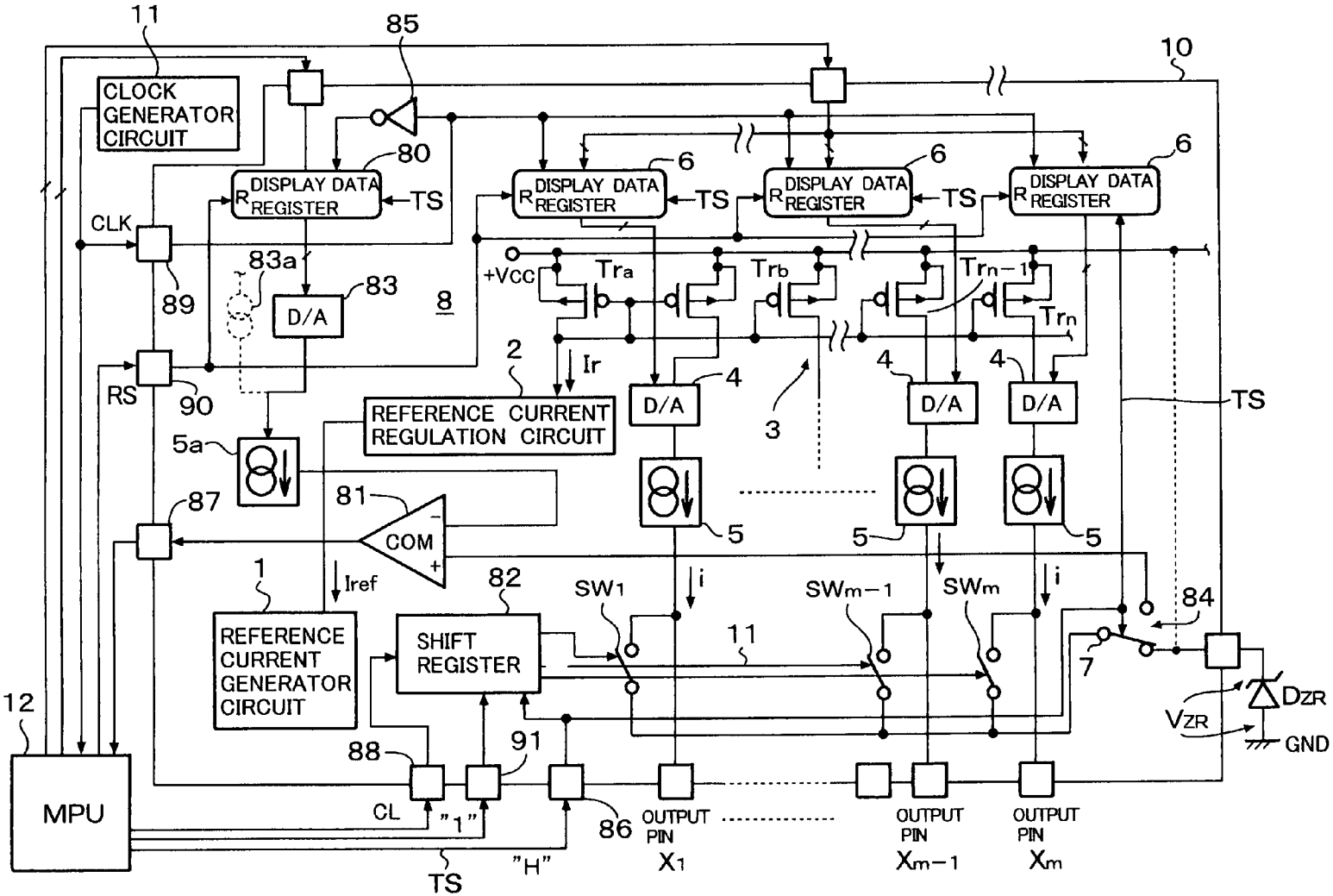
FIG. 1 is a block circuit diagram of an organic EL drive circuit of an organic EL panel, according to an embodiment of the present invention.

A column driver 10 shown in FIG. 1 is formed as a column IC chip functioning as an organic EL drive circuit of an organic EL panel.

The column driver 10 includes a reference current generator circuit 1, a reference current regulation circuit 2, a reference current distribution circuit 3, D/A converter circuits 4 and output stage current sources 5 supplied with drive currents from the D/A converter circuits 4. The D/A converter circuits 4 and the output stage current sources 5 are provided correspondingly to respective output pins X1 to Xm of the column driver 10, which are connected to respective terminal pins of an organic EL display panel.

The reference current generator circuit 1 supplies a reference current Iref to the reference current regulation circuit 2. The reference current regulation circuit 2 regulates the reference current Iref by laser trimming in an IC fabrication step or data setting in an internal D/A converter circuit to generate a reference drive current Ir and sends the reference drive current Ir to the reference current distribution circuit 3. The reference current regulation circuit 2 is provided for each of R, G and B display colors to regulate the reference current Iref corresponding to each display color.

Provided externally of the column driver IC 10 are a clock generator circuit 11 and an MPU (propriety judge device) 12 for testing drive currents at the respective output pins.

Figure 2:
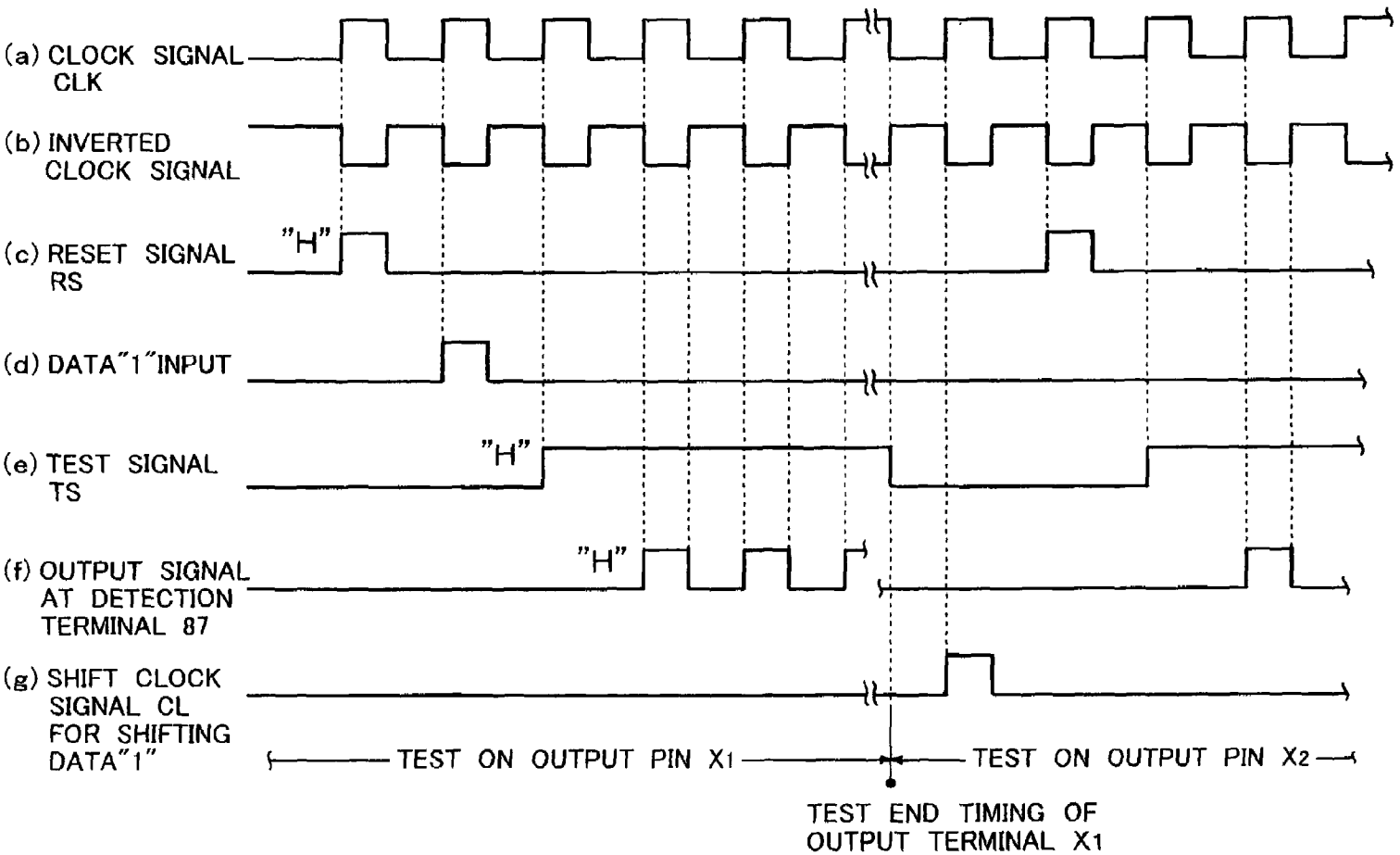
FIG. 2(*a*) to FIG. 2(*g*) show a timing chart of a judge operation of a drive current judge circuit of the column driver of the organic EL panel shown in FIG. 1.

Incidentally, the clock generator circuit 11 generates a clock signal CLK (see FIG. 2(*a*)) having duty cycle of 50% and sends the clock signal to the column driver IC 10 and the MPU 12.

In the column driver IC 10, reset switches SW1, . . . , SWm-1, SWm are connected to respective column side output pins X1 to Xm to reset the organic EL elements to a constant voltage VZR by turning the reset switches SW1, . . . , SWm-1, SWm ON in a reset period. The constant voltage VZR is a terminal voltage of a Zener diode DZR.

In this embodiment, a drive current judge circuit 8 is provided in the column driver IC 10. The drive current judge circuit 8 sequentially judges the propriety of the drive currents outputted to the output pins X1 to Xm by sequentially selecting the drive currents by means of the reset switches.

The drive current judge circuit 8 includes a display data register 80, a comparator (COM) 81, a shift register 82, a D/A converter circuit 33, a switch 84, an inverter circuit 85 and an output stage current source 5*a* having identical construction to the output stage current source 5.

One terminals of the reset switches SW1 to SWm are connected to a common terminal 7. The switch 84 has one terminal connected to the common terminal 7 and the other two terminals respectively connected to a (+) input terminal of the comparator circuit 81 and the constant voltage diode DZR. In the test period of the column driver IC 10, the common terminal 7 is switched to the (+) input side of the comparator circuit 81. In this embodiment, the constant voltage diode DZR is provided externally of the column driver IC 10.

A test terminal 86 functions to set the column driver IC 10 in the test state. The column driver IC 10 further includes a detection terminal 87 at which a result of test is obtained, a shift clock input terminal 88, a clock input terminal 89 to which the clock signal CLK from the clock signal generator circuit 11 is supplied, a reset terminal 90 for resetting the display data registers 6 and the display data register 80 and a 1-bit data input terminal 91.

The common terminal 7 of the switch 84 is normally grounded through the constant voltage diode DZR. When a test signal TS in High (H) level is inputted to the test terminal 86, the common terminal 70 is switched to the (+) input terminal of the comparator circuit 81.

The shift register 82 constitutes a switch circuit for turning the reset switches SW1 to SWm ON one by one sequentially. Output signals of respective stages of the shift register 82 are supplied to the respective reset switches as ON/OFF control signals.

The test signal TS, H level of which is significant, inputted to the test terminal 86 is supplied from the MPU 12 to the shift register 82 and the display data registers 6 and 80. Upon the test signal TS in H level, the shift register 82 is enabled to perform a shift operation according to a shift clock signal CL supplied from the MPU 12 to the shift clock input terminal 88.

The D/A converter circuit 83 has resolution of 0.5 LSB, which is higher than the resolution of the D/A converter circuit 4 by 1 digit (1 bit). Assuming that the D/A converter circuit 4 is, for example, a 8-bit converter, the D/A converter circuit 83 is a 9-bit converter corresponding to the D/A converter 4 added with a least significant bit, which is preliminarily set to "1" fixedly. The 8-bit display data of the display data register 80 are set in the remaining bits of the D/A converter circuit 83 except the digit of the least significant bit. The analog current outputted from the D/A converter circuit 83 is sent to an output stage current source 5*a* provided correspondingly thereto.

On the other hand, the 8-bit display data of the display data register 6 are set in the all bits of the D/A converter circuit 4. The analog current outputted from the D/A converter circuit 4 is sent to an output stage current source 5 provided correspondingly thereto.

The display data register 80, which is constructed identically to the display data register 6, is provided correspondingly to the D/A converter circuit 83 and stores the same display data as that set in the display data registers 6.

The 8-bit display data of which all of 8 bits are "0", set in the display data registers 6 and the display data register 80 are incremented upon the test signal TS in H level at the test terminal 86. That is, the display data in the display data registers 6 are incremented according to the clock signal CLK (FIG. 2(*a*)) inputted from the clock input terminal 88 and the display data register 80 increments the display data according to a clock signal CLK (FIG. 2(*b*)), which is inverted by the inverter circuit 85. Incidentally, the remaining 8-bits (the display data) except the least significant bit in the D/A converter circuit 83 are incremented according to the clock signal CLK while the least significant bit of the D/A converter circuit 83 data being fixed to "1".

As a result, an increment timing of the display data in the display data register 80 according to the inverted clock signal CLK is deviated from that of the display data of the display data register 6 by a half clock period.

The comparator 81 compares the drive currents on the side of the D/A converter circuits 4 with the reference current on the side of the D/A converter circuit 83. That is, the comparator 81 compares the drive current from each of the D/A converter circuits 4 through the output stage current source 5 with the drive currents obtained from the D/A converter circuit 83 through the output stage current source 5*a* as reference currents to judge whether or not the drive current from each of the output stage current sources 5 is larger or smaller than the reference current from the output stage current sources 5*a*. That is, the comparator 81 compares one of the drive currents at the output pins X1 to Xm supplied to the (+) input terminal thereof with the output current of the D/A converter circuit 83 supplied to the (−) input terminal thereof through the output stage current source 5*a*. The comparator 81 outputs, "H" signal to the detection terminal 87 when the drive current supplied to the (+) input terminal of the comparator 81 is larger than the reference current supplied to the (−) input terminal thereof, otherwise, the comparator 81 outputs "L" signal.

The reference current distribution circuit 3 has a current mirror construction including an input side P channel MOSFET Tra and a plurality of output side P channel MOSFETs Trb to Trn. Sources of the output side transistors Trb to Trn are connected to a power source line +Vcc (=+3V) and drains thereof are connected to the respective D/A converter circuits 4. Output currents of the transistors Trb to Trn are used as reference drive currents of the D/A converter circuits 4, respectively. A source of the transistor Tra is connected to the power source line +Vcc and a drain thereof is connected to an output terminal of the reference current regulation circuit 2.

On the other hand, in an operating state of the organic EL display device, each D/A converter circuit 4 receives the display data from other MPU (not shown) through the display data register 6 provided correspondingly to the output pin of the column driver 10 and generates the drive current corresponding to display luminous intensity by amplifying the reference drive current according to the display data. The thus generated drive currents are supplied to the respective output stage current sources 5 to drive the latter sources.

Each output stage current source 5 is constituted with a current mirror circuit having a pair of transistors. The output stage current sources 5 send the drive currents i, which correspond to the display data and supplied from the respective D/A converter circuits 4, to the output pins X1 to Xm of the column driver 10, which are connected to the terminal pins connected to anodes of the organic EL elements of the organic EL display panel, respectively.

Incidentally, the output side current sources 5 are supplied with electric power from a power source line (not shown) of about +5.5V.

Now, the judge operation of the drive current judge circuit 8 for performing the propriety test for drive currents of the organic EL element drive circuit will be described with reference to a timing chart shown in FIG. 2(*a*) to FIG. 2(*g*).

In response to the reset signal RS (FIG. 2(*c*)) supplied from the reset terminal 90 in synchronism with the clock signal CLK, the MPU 12 resets the display data registers 6 and the display data register 80 and inputs "1" to the shift register 82. The "1" input is set in an initial stage of the shift register 82 (FIG. 2(*d*)). Therefore, an output of the initial stage of the shift register becomes "1", upon which the switch SW1 is turned ON. Since outputs of the other stages of the shift register 82 is "0" initially, the switches SW2 to SWm are kept OFF. As a result, the output current at the output pin X1 is supplied to the (+) input terminal of the comparator 81 through the switch SW1. On the other hand, the D/A converter circuit 83 converts the display data set in the display data register 80 into an analog current and the output stage current source 5*a* is driven by the analog current. A current generated by the output stage current source 5*a* is supplied to the (−) input terminal of the comparator 81.

In order to switch the column drive IC 10 to the test stage and start the test, the MPU 12 sends the test signal TS ("H") to the test terminal 86 (FIG. 2(*e*)). Therefore, the 8-bit display data in each of the display data registers 6 and the 8-bit display data in the display data register 80 are incremented sequentially according to the clock signal CLK.

Figure 3:
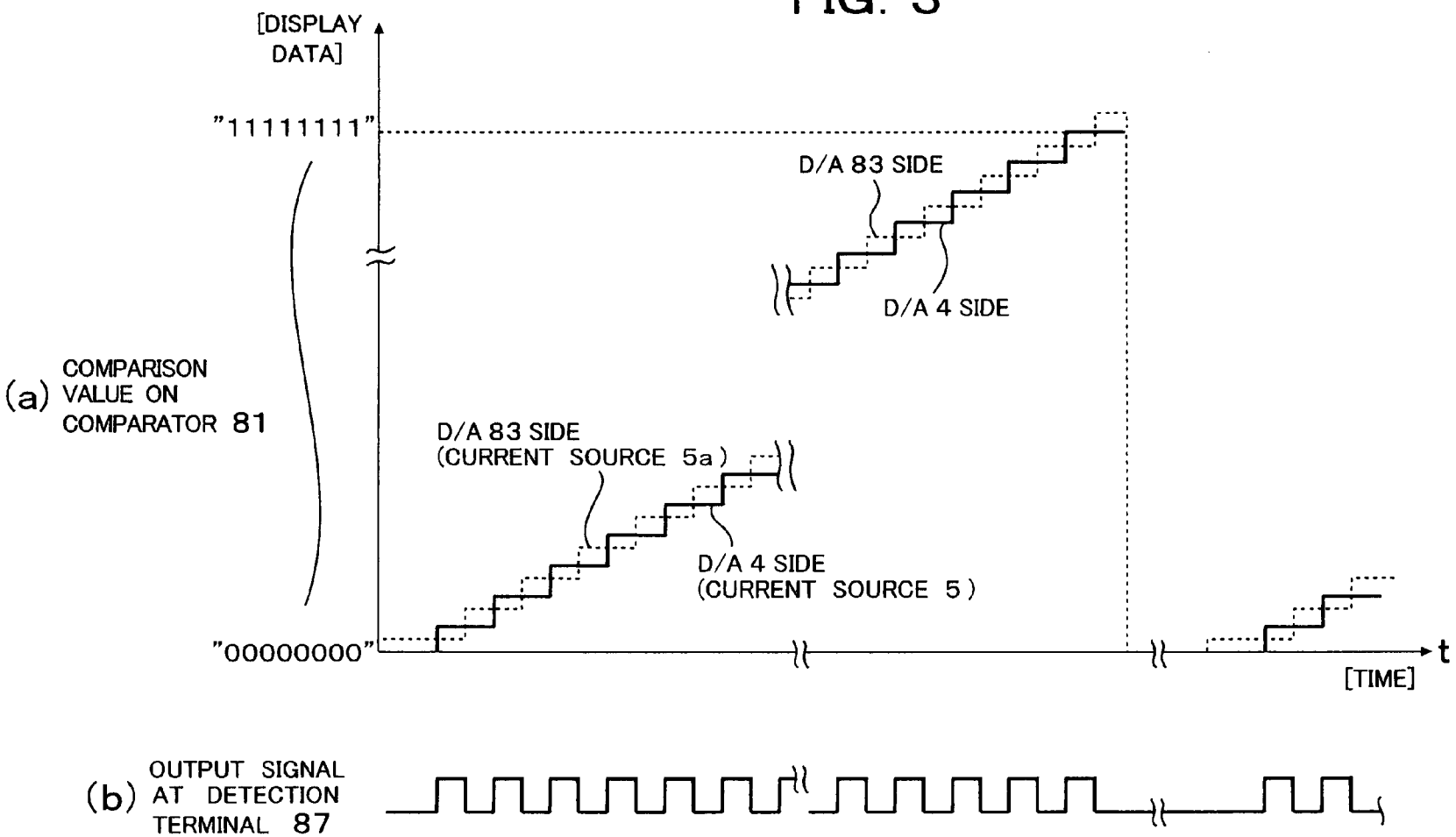
FIG. 3(*a*) to FIG. 3(*b*) show a change of a reference current for comparison in the drive current judge circuit.

As a result, the 8-bit display data of each of the display data registers 6 and the display data register 80 are incremented from the all bit "0" state sequentially according to the clock signal CLK from the clock generator circuit 11 and the resultant analog drive currents from each of the current sources 5 are compared with the reference drive current from the current source 5*a* by the comparator 81. FIG. 3(*a*) illustrates the comparison performed by the comparator 81 and FIG. 3(*b*) shows an output signal at the detection terminal 87.

The comparison is performed by the comparator 81 from a case where all of 8 bits of the display data are "0" to a case where all of the 8 bits are "1".

Incidentally, the resetting of each of the display data registers 6 and the display data register 80 is to set all of the 8 bits thereof to "0" and the setting of the display data is to increment all of the 8 bits to "1". That is, in this case the setting of the display data in registers is performed by resetting "0" in all bits of the display data registers 6 and the display data register 80 and by incrementing it. This resetting is equal to setting 8-bits all "0" of the display data from the MPU 12 to each of the display data registers 6 and the display data register 80 and the incrementing of the display data from "1" to all of the 8 bits "1" is equal to setting "1" to all of the 8 bits "1" of the display data from the MPU 12 to each of the display data registers 6 and the display data register 80.

Further, the resetting of the display data in the all bits "1" state is performed by decrementing the 8 bits and the resetting of the 8-bit display data in the all bits "0" state is performed by incrementing it.

On the side of the D/A converter circuit 4, a drive current shown by a solid line in FIG. 3(*a*) is generated in the output stage current source 5 according to the clock signal CLK. On the other hand, on the side of the D/A converter circuit 83, a drive current shown by a dotted line in FIG. 3(*a*) is generated in the output stage current source 5*a* according to the clock signal CLK, because the least significant bit of the 9-bit data set in the D/A converter circuit 83 is fixed to "1". In this case, since the 8-bit display data in the display data register 80 on the side of the D/A converter circuit 83 are incremented according to the clock signal obtained by inverting the clock signal CLK having duty cycle of 50%, the increment timing is deviated from that of the 8-bit display data of the display data register 6 on the side of the D/A converter circuit 4 by a half clock period. Therefore, the drive current generated on the side of the D/A converter circuit 83 at the output stage current source 5*a* is deviated from the drive current generated on the side of the D/A converter circuit 4 at the output stage current source 5 by a half clock period. In addition, the analog current on the side of the D/A converter circuit 83 is larger than that on the side of the D/A converter circuit 4 by a value corresponding to 0.5 LSB.

As a result, the drive current generated on the side of the D/A converter circuit 4 is deviated from that generated on the side of the D/A converter circuit 83 by a half clock period and the comparator 81 performs the current comparison under such condition as shown in FIG. 3(*a*). As shown in FIG. 3(*a*), the 8-bit display data on the side of the D/A converter circuit 83 is increased by 1 LSB at a center of each clock period, so that the analog current from the D/A converter circuit 83 is increased correspondingly. Therefore, the D/A converter circuit 83 outputs two reference currents in each clock period and the comparator 81 compares the analog current from the D/A converter circuit 4 twice with the two reference currents from the D/A converter circuit 83.

Since the display data in the display data register 83 is sequentially incremented according to the inverted clock, the drive current on the side of the D/A converter circuit 4 is compared by the comparator 80 with the analog reference current, which is decreased by the value corresponding to 0.5 LSB for the drive current on the side of the D/A converter circuit 4, in the preceding half of the clock period and the analog reference current, which is increased by the value corresponding to 0.5 LSB for the drive current on the side of the D/A converter circuit 4, in the succeeding half clock period.

As a result, the sequentially incremented drive current on the side of the D/A converter circuit 4 is compared twice with the sequentially increasing reference drive current on the side of the D/A converter circuit 83 in each clock period and a detection output signal, which takes "H" levels and "L" levels alternately in synchronism with the clock signal CLK, is generated by the comparator 81 and supplied to the detection terminal 87 as shown in FIG. 2(*f*).

When the 8-bit display data from minimum value with all bits being "0" to maximum value with all bits being "1" are set in the display data registers 6 and 80 and the "H" and "L" are generated alternately, the output current at the output pin X1 becomes in between the preceding reference current and the succeeding reference current, which are sequentially incremented according to the clock signal CLK. Therefore, the output current at the output pin X1 is judged as being adequate. Otherwise, the output current at the output pin X1 is judged as being inadequate.

The output at the detection terminal 87 is sent to the MPU 12. In the MPU 12, it is determined whether or not "H" and "L" are generated alternately according to the clock signal CLK and the number of "Hs" as well as the number of "Ls" are determined. The drive current is judged as being appropriate when "H" and "L" are the same in number and/or the number of "H" and the number of "L" correspond to the number of increments.

After the number of the clock signals CLK from the clock generator circuit 11 to the MPU 12 becomes equal to the number of increments up to the maximum value, the test signal TS becomes "L" and the test on the output terminal X1 is ended (FIG. 2(*e*)).

Next, the MPU 12 sends a shift clock signal CL (FIG. 2(*g*)) to a shift clock input terminal 88 of the column driver 10 in synchronism with the clock signal CLK. Upon the shift clock signal CL, the data "1" set in an initial stage of the shift register 82 is shifted to a next stage of the shift register 82. Therefore, the initial stage of the shift register 82 becomes "0" , upon which the switch SW1 is turned OFF and the switch SW2 supplied with the "1" output of the next stage is turned ON. Therefore, the output current at the output pin X2 is supplied to the (+) input of the comparator 81 through the switch SW2. Since outputs of other stages of the shift register 82 are "0", the switches SW3 to SWm are kept OFF.

In response to a reset signal (FIG. 2(*c*)) supplied from the MPU 12 to the reset terminal 90 of the column driver 10, the display data registers 6 and 80 are reset. Similarly, in order to switch the operation mode to the test state, the MPU 12 sends a test signal TS ("H") to the test terminal 86 of the column driver 10 and a next test is started (FIG. 2(*e*)). As a result, it is possible to obtain, at the detection terminal 87, an output signal including alternating "H" and "L" indicating propriety of the drive current at the output pin X2, as shown in FIG. 2(*f*).

In this manner, it is possible to test the propriety of the drive currents at the respective output pins X1 to Xm of the column driver IC 10 continuously and reliably at high speed.

Incidentally, in the embodiment shown in FIG. 1, the drive currents supplied to the respective output pins X1 to Xm of the column driver 10 are supplied from the output stage current sources 5 provided correspondingly to these output pins.

On the other hand, since, in a drive circuit of an active matrix type organic EL display panel, the drive current is smaller and the current sink output is usually generated, the output stage current sources 5 provided correspondingly to the respective D/A converter circuits 4 become unnecessary. Therefore, when the present invention is applied to the active matrix type drive circuit, it is usual that the output stage current sources 5 are removed to use the D/A converter circuits 4 as the output stages and the output currents of the D/A converter circuits 4 are used as the drive currents. In such case, the output stage current sources 5 on the side of the D/A converter circuits 4 and the output stage current source 5*a* on the side of the D/A converter circuit 83 are removed and the analog currents from the D/A converters 4 are compared with the analog reference current from the D/A converter circuit 83 directly.

In this embodiment, the increment timing of the display data of the display data registers 6 and 80 is deviated the display data thereof from the display data of each display data register 6 by a half clock period after the display data of the display data registers 6 and 80 is reset. However, these display data may be outputted from the MPU 12. Further, the difference in increment timing of the display data between the display data register 6 and the display data register 80 is not limited to a half clock period. Further, after the display data registers 6 and the display data register 80 are reset, the MPU 12 may set the maximum value of the display data in the display data registers 6 and 80 and the maximum value may be decremented according to the clock signal CLK.

In this embodiment, the display data on the side of the D/A converter circuit 83 is deviated from the display data on the side of the D/A converter circuit 6 by ½ clock period by using the clock CLK having duty cycle of 50% and inverted by the inverter circuit 85. Therefore, by generating the analog current of the D/A converter circuit 83 after ½ clock period from the analog current on the side of the D/A converter circuit 4 and by increasing the analog current of the D/A converter circuit 83 by a value corresponding to 1 LSB within 1 clock period, the two reference currents are generated. Thus, the comparison is performed twice within 1 clock period. However, in the present invention, neither the deviation of the display data on the side of the D/A converter circuit 83 by ½ clock period nor the twice comparison is indispensable. That is, in order to deviate the display data on the side of the D/A converter circuit 83 from the display data on the side of the D/A converter circuit 4 by a value corresponding to 1 LSB within 1 clock period, it is enough to increase or decrease the display data of the D/A converter circuit 83 by the value corresponding to 1 LSB within the clock period. By providing the two values to the analog reference current outputted from the D/A converter circuit 83 with respect to the analog drive current from the D/A converter circuit 4, the two comparisons with respect to the analog current of the D/A converter circuit 4 become possible. Further, since the reference current values, which are larger and smaller than the analog drive current of the D/A converter circuit 4, respectively, are set by increasing the analog reference current of the D/A converter circuit 83 by a value corresponding to 1 LSB, the reliability of detection can be improved. It may be possible to generate a constant output current of the D/A converter circuit 4 for 2 clock periods and to generate a reference current, which is different from the constant current by a value corresponding to 1 LSB, according to the clock signal CLK.

Since the display data of the D/A converter circuit 4 for 1 horizontal line are usually set simultaneously in the organic EL element drive circuit, the setting of display data is made by setting the same display data in the display data registers 6 simultaneously in the described embodiment. However, according to the present invention, it may be possible to set same display data in one of the display data registers 6 and the display data register 80, outputs of which are to be compared by the comparator 81 at every time, simultaneously.

In the described embodiment, each D/A converter 4 is an 8-bit D/A converter and the D/A converter circuit 83 is a 9-bit D/A converter having the least significant bit is fixed to "1" corresponding to 0.5 LSB. The display data register 80 may be a n-bit register having the least significant bit is fixed to "1" corresponding to 0.5 LSB. In such case, the n-bit data of the display data register 80 are set in the n-bit D/A converter circuit 83.

Therefore, the reference current through the output stage current source 5*a* may be generated by providing the current source 83*a* (shown by a dotted line in FIG. 1) for generating a current having resolution of 0.5 LSB in parallel to the D/A converter 83 and by adding an analog current corresponding to 0.5 LSB to the output analog current of the D/A converter circuit 83 to provide an offset corresponding to 0.5 LSB. In such case, the D/A converter circuit 83 may be an 8-bit D/A converter. That is, a D/A converter identical to the D/A converter circuit 4 may be used as the D/A converter circuit 83.

Incidentally, the reference current may be generated by subtracting an analog current of the current source 83 corresponding to 0.5 LSB from the output analog current of the D/A converter circuit 83.

Further, it is enough that the D/A converter circuit 83 can generate current whose resolution is equal to or higher than that of the D/A converter circuit 4 and the difference in bit between the D/A converter circuit 83 and the D/A converter circuit 4 is not limited to 1 bit.

Further, although, in the described embodiment, the output stage current source 5*a*, the display data register 80, the comparator 81 and the shift register 82, etc., operate even in a time period in which the test signal is not supplied, the operations of these components in that time period may be stopped. In such case, it is preferable that the test signal TS shown in FIG. 2(*e*) is generated before the reset signal RS shown in FIG. 2(*c*).

Although the result of judgment on the propriety of drive currents at the output pins X1 to Xm is sent externally by utilizing the reset switches SW1 to SWm in the described embodiment, switch means similar in function to the reset switches may be provided therefore. In such case, the switch 84 becomes unnecessary.

Incidentally, in a drive circuit for an active matrix type organic EL display panel, a write voltage of black level is set in a capacitor of each pixel circuit for a resetting thereof. In such case, the terminal of the switch 84 may be connected to not the constant voltage diode DZR but the power source line +Vcc or a dotted voltage line shown by a dotted line, whose voltage is lower than the power source line +Vcc by a constant voltage. In such case, the reset switches SW1 to SWm may be precharge switches for performing a constant voltage resetting for write of black level. In such case, the output stage current sources 5 for writing voltage values of capacitors of the pixel circuits are usually of the current sink type.

It should be noted that the term "output current" used in the description of the present specification and claims appended thereto includes a discharge drive current and a sink drive current.

The output stage current source 5*a* may be made inactive when the test signal is absent.

What is claimed is:

1. An organic EL panel drive circuit for generating drive currents for driving an organic EL display panel at a plurality of output pins of said organic EL panel drive circuit, which are provided corresponding to a plurality of terminal pins of said organic EL display panel, respectively, said organic EL panel drive circuit comprising:

a plurality of first D/A converter circuits provided correspondingly to said output pins, for converting digital display data into first analog currents, respectively;

a plurality of switch circuits provided correspondingly to said output pins, said switch circuits being adapted to ON/OFF control the first analog currents or drive current obtained by passing the first analog currents through output stage current sources provided correspondingly to said output pins;

a second D/A converter circuit having a least significant bit resolution of which is higher than the least significant bit of each said first D/A converter circuit, for generating a second analog current as a reference current by D/A-converting data corresponding to the display data;

a comparator circuit for comparing the first analog currents outputted through said switch circuits or the drive currents with the second analog current or a current obtained by passing the second analog current through an output stage current source; and a control circuit for turning said switch circuits ON one by one sequentially, a result of the comparison of said comparator being outputted externally.

2. The organic EL panel drive circuit as claimed in claim 1, wherein said second D/A converter circuit includes a third D/A converter circuit having resolution corresponding to the least significant bit of said first D/A converter and a current source for generating a current smaller than a current corresponding to resolution of the least significant bit of said first D/A converter, said second D/A converter circuit generates the second analog current as a sum of a current obtained by a D/A conversion of the D/A-converting data having a value equal to the value of the display data and a current of said current source.

3. The organic EL panel drive circuit as claimed in claim 1, wherein the D/A-converting data is either one of the display data, data having a value, which is the same as a value of the display data, and the display data added with a least significant bit, the second analog current is larger or smaller than said first analog current by a value corresponding to a current smaller than a current corresponding to the least significant bit of said first D/A converter circuit and the result of comparison is generated as a High level signal or a Low level signal.

4. The organic EL panel drive circuit as claimed in claim 3, wherein said control circuit includes a second switch circuit for turning said first switch circuits ON one by one sequentially, said second analog current has a preceding current value and a succeeding current value with respect to the current value of said first analog current converted by each said first D/A converter circuit and said comparator compares the first analog current of said first D/A converter circuit twice with the preceding and succeeding current values of said second analog current.

5. The organic EL panel drive circuit as claimed in claim 4, wherein said preceding current value of the second analog current is smaller than said first analog current and said succeeding current value of the second analog current is larger than said first analog current.

6. The organic EL panel drive circuit as claimed in claim 5, wherein said first switch circuits are reset switches for resetting charges of said organic EL elements or precharge switches for performing a write of black level, the number of bits of said second D/A converter circuit is larger than that of said first D/A converter by one, the one bit of said second D/A converter circuit is the least significant bit set to "1", the D/A-converting data is the same as the display data or the data having a value, which is the same as the value of the display data, is set in the remaining bits of said second D/A converter circuit.

7. The organic EL panel drive circuit as claimed in claim 6, wherein D/A conversions of said first and second D/A converter circuits are performed in synchronism with a clock signal, the D/A-converting data set in said second D/A converter circuit is incremented or decremented within the clock period to allow said comparator to perform the comparison twice within the clock period.

8. The organic EL panel drive circuit as claimed in claim 7, wherein the D/A-converting data is incremented or decremented by a value corresponding to 1 LSB of said first D/A converter circuit with a timing deviated from the first analog current of said first D/A converter circuit by ½ clock period.

9. The organic EL panel drive circuit as claimed in claim 8, wherein said second switch circuit is a shift register having output stages connected to said first switch circuits, respectively, and the timing deviated from that of said first D/A converter circuit by ½ clock period is generated according to a clock signal obtained by inverting the clock signal.

10. The organic EL panel drive circuit as claimed in claim 9, wherein a plurality of registers are provided correspondingly to said first and second D/A converter circuits, respectively, and the display data is set in each said register.

11. The organic EL panel drive circuit as claimed in claim 10, wherein the setting of the display data in said registers is performed by resetting "0" in all bits of said register or by resetting "1" in all bits of said register, the D/A-converting data set in said register is sequentially incremented from the minimum value corresponding to an all bits "0" state to the maximum value corresponding to an all bits "1" state according to the clock signal or sequentially decremented from the maximum value to the minimum value according to the clock signal.

12. A propriety test method of drive currents of an organic EL element drive circuit formed in an IC chip, which generates the drive currents for driving an organic EL display panel at a plurality of output pins of said organic EL panel drive circuit, which are provided corresponding to a plurality of terminal pins of said organic EL display panel, respectively, said organic EL element drive circuit comprising:

a plurality of first D/A converter circuits provided correspondingly to said output pins, for converting digital display data into first analog currents, respectively;

a plurality of switch circuits provided correspondingly to said output pins, said switch circuits being adapted to ON/OFF control the first analog currents or the drive currents obtained by passing the first analog currents through output stage current sources provided correspondingly to said output pins;

a second D/A converter circuit having a least significant bit, resolution of which is higher than the least significant bit of each said first D/A converter circuit, for generating a second analog current as a reference current by D/A-converting data corresponding to the display data;

a comparator circuit for comparing the first analog currents outputted through said switch circuits or the drive currents with the second analog current or a current obtained by passing the second analog current through an output stage current source; and a control circuit for turning said switch circuits ON one by one sequentially, wherein a result of the comparison of said comparator is outputted externally and the propriety of the drive currents generated by said organic EL element drive circuit at respective said output pins is tested according to the result of comparison obtained from said IC chip.

13. The propriety test method as claimed in claim 12, further comprising a propriety judge device provided externally of said IC chip, wherein said propriety judge device judges the number of High level signals and the number of Low level signals in the result of comparison, which are alternately generated according to the clock signal.

14. The propriety test method as claimed in claim 12, wherein said propriety judge device judges the drive current as being appropriate when the High level signals and the Low level signals are the same in number and/or the numbers of the High level signals and the Low level signals corresponds to a number of increments.

15. The propriety test method as claimed in claim 12, wherein the D/A-converting data is either one of the display data, data having a value, which is the same as a value of the display data, and the display data added with a least significant bit, the second analog current is larger or smaller than said first analog current by a value corresponding to a current smaller than a current corresponding to the least significant bit of said first D/A converter circuit and the result of comparison is generated as a High level signal or a Low level signal.

16. The propriety test method as claimed in claim 15, wherein said control circuit includes a second switch circuit for turning said first switch circuits ON one by one sequentially, said second analog current has a preceding current value and a succeeding current value with respect to the current value of said first analog current converted by each said first D/A converter circuit and said comparator compares the first analog current converted by said first D/A converter circuit twice with the preceding current value and the succeeding current value of said second analog current.

17. The propriety test method as claimed in claim 16, wherein said first switch circuits are reset switches for resetting charges of said organic EL elements or precharge switches for performing a write of black level, the number of bits of said second D/A converter circuit is larger than that of said first D/A converter by one, the one bit of said second D/A converter circuit is the least significant bit set to "1", the D/A-converting data is the same as the display data or the data having a value, which is the same as the value of the display data, is set in the remaining bits of said second D/A converter circuit.

18. The propriety test method as claimed in claim 17, wherein D/A conversions of said first and second D/A converter circuits are performed in synchronism with a clock signal, the D/A-converting data set in said second D/A converter circuit is incremented or decremented within the clock period to allow said comparator to perform the comparison twice within the clock period.

19. The propriety test method as claimed in claim 18, wherein the D/A-converting data is incremented or decremented by a value corresponding to 1 LSB of said first D/A converter circuit with a timing deviated from that of said first D/A converter circuit by ½ clock period.22

* * * * *